US005833400A

United States Patent [19]

Wamsher

[11] Patent Number: 5,833,400

[45] Date of Patent: Nov. 10, 1998

[54] CUT-PIPE EARTH ANCHOR

[76] Inventor: John D. Wamsher, 470 McAmant Dr., Santa Cruz, Calif. 95060

[21] Appl. No.: 834,203

[22] Filed: Apr. 15, 1997

[51] Int. Cl.[6] ..... E02D 5/74

[52] U.S. Cl. ..... 405/244; 52/163; 405/259.1

[58] Field of Search ..... 405/244, 259.1; 52/163, 162, 166, 155

[56] References Cited

U.S. PATENT DOCUMENTS

| | | | |
|---|---|---|---|
| 1,564,069 | 12/1925 | Hoovens | 52/163 |
| 4,096,673 | 6/1978 | Deike | 405/244 X |
| 4,727,694 | 3/1988 | Rockenfeller et al. | 52/163 |
| 5,123,779 | 6/1992 | Miller | 405/244 X |
| 5,175,966 | 1/1993 | Remke et al. | 405/244 X |
| 5,625,984 | 5/1997 | Chapman et al. | 52/163 X |
| 5,649,788 | 7/1997 | Jewett | 405/244 |

*Primary Examiner*—Dennis L. Taylor
*Attorney, Agent, or Firm*—Donald R. Boys

[57] ABSTRACT

An earth anchor is made from a length of tubing that has angle-cut ends and a pulling attachment pivotally attached to an axle attached across the tubing at right angles to the length of the tubing. The anchor is lowered into an earth bore in a relatively vertical position to be rotated axially via a pull-tension applied to link attached to the pulling attachment. Upward motion causes the anchor to rotate about the axle, burrowing into the surrounding earth until the anchor is lodged in a horizontal position in the earth bore. The link extends to above ground and has a suitable fixture for securing to an object to be anchored. A double-cone effect produced by the compacting action of the angled cut-outs and the continued upward pull via the pull rod, compacts the earth above the anchor in continually expanding cones, and fills the inside of the main body of the anchor with compacted ground.

9 Claims, 3 Drawing Sheets

CUT-PIPE EARTH ANCHOR

FIELD OF THE INVENTION

The present invention is in the field of a construction technique known in the art as earth anchoring, and has particular application to the type of earth anchors that are designed to rotate to a horizontal position in the ground for anchoring cables, guy rods, and the like.

BACKGROUND OF THE INVENTION

Of the types of earth anchors used in the construction trades, horizontally-positioning earth anchors, sometimes termed plate or wing anchors, are at the time of this application most commonly used to anchor cables, guy rods, and the like, to the ground. This particular technique provides increased stability for certain elements of a construction project such as pillars, frames, poles, and the like. In one important application, earth anchors are used for providing stability for light-frame buildings, such as house trailers and the like, which are now being used for many purposes other than homes, such as for temporary and semi-permanent classrooms.

In one sort of earth anchor, installation involves boring a hole in the earth to a specified depth to which the anchor can then be lowered. After being lowered to a desired depth in an earth bore, the anchor, which is designed to tilt in a vertically-suspended position, initiates contact with the sidewall of the bore and catches when a pull-tension is applied via a pull-rod or an attached cable. This action produces a cantilever action that rotates the anchor axially causing it to become lodged into the surrounding earth in a horizontal aspect. Some of these anchors are designed with impact sockets for the purpose of being driven into the ground where there is no pre-existing bore via a driving rod and mallet, a jackhammer, or some other impact device used for this purpose. Often other construction techniques are employed after the anchor is lodged such as adding concrete, plugging or capping the top of the bore, and so on.

Earth anchors as known in the art and prior to the present invention have a number of limitations related to proper function. For example, a wing-type anchor known as a planing fin anchor in the art, is made of plates of steel assembled to have a central palate with horizontally extending wings or flanges. U.S. Pat. No. 3,969,854 granted to Robert F. Deike on Jul. 20, 1976 is a good example of a planing fin anchor. Plate metal construction wherein laterally extending plate structures are relied upon to provide resistance to movement are susceptible to structural failure, particularly along the base of the extended wings or fins, are therefore limited to the forces that can anchor. These anchors tend to crack and buckle under excessive applied forces.

It is well known in the art of metal fabrication that any structure containing sharp right angles, whether forged, welded, cast, or extruded, is somewhat weaker at the right-angle comers. Therefore, a wing or plate anchor of this form is functionally limited and restricted to smaller jobs that require limited to be applied to the anchor. Also, the leading edges of this type of anchor are wide in berth, therefore, prone to deflection when encountering rocks or other hard material as in the case of impact driving.

Another earth anchor in the art is taught in U.S. Pat. No. 4,802,317, issued to David R. Chandler on Oct. 29, 1987. This anchor is a modified type of plate anchor that is specifically designed to be driven into the ground with a jackhammer. This anchor incorporates a tubular body section that acts as an impact socket for accepting a driving rod.

This feature is cast from an aluminum-bronze alloy or ductile iron along with the other features of the anchor, which include right angle fins or wings extending out from the tubular socket. This anchor has the same drawbacks as the planing fin anchor described above, plus the expense of this type of fabrication is substantially greater than the previously described planing fin Anchor. Also, creating the sharpened wing edges, that are part of the design, require additional processes such as machining, edge grinding, and the like. Furthermore, casting metals can sometimes leave pockets of air or porous areas under the surface of the metal providing further potential weak spots. Finally this anchor is limited to impact installation.

A third type of anchor known in prior art is taught by U.S. Pat. No. 4,044,513 issued to Robert F. Deike on Aug. 30, 1977. This anchor is tubular in construction, eliminating potential weaknesses provided by sharp corners, but at a sacrifice of area presented in the direction of anchoring force. This particular anchor is designed to be driven into the ground solely by impacting as is one of the other anchors described above, and the round construction of most of the length of the structure presents a curved surface in resistance to movement, which limits the force that may be supported. Hence the inventor prefers anchoring this device with poured concrete. Furthermore, this anchor is designed in a way that the ends on each side of an attachment (cable, rod or the like) are very different, and in operation applied forces Tend to rotate this anchor away from horizontal, severely limiting the forces that may be applied.

What is clearly needed is a new earth anchor with a balanced design, inexpensive to manufacture, and providing enhanced holding capability in all types of earth over previously known devices.

SUMMARY OF THE INVENTION

In a preferred embodiment of the present invention an earth anchor is provided, comprising a body section formed from a hollow tubing having an axis lying in a plane of symmetry and ends cut in planes, each end plane forming an inward acute angle with the axis on the same side of the axis, and intersecting the plane of symmetry of the tubing at right angles; an axle positioned within the hollow tubing in a portion of the tubing between the end planes, the axle fixedly attached across the tubing in a direction substantially at a right angle to the plane of symmetry; and a pulling apparatus pivotally attached to the axle such that the pulling apparatus may be rotated around the axle through an angle of at least ninety degrees, to extend in one aspect parallel to the axis of the tubing, and in another aspect at ninety degrees to the axis of the tubing through an opening from one end adapted to provide clearance for rotation of the pulling apparatus.

In some embodiments the hollow tubing is metal pipe of circular cross-section. Also in some embodiments the axle position is offset from center of the overall length of the tubing, providing thereby a longer portion to one side of the axle and a shorter portion to the other side of the axle. Further, the acute angles are preferably different angles, each less than forty-five degrees. Still further, in some embodiments the axle has a central axis, and the axle axis is offset to the same side of the axis of the tubing as the disposition of the acute angles of the planes, such that the axis of the axle and the axis of the tubing do not intersect.

In some embodiments the material of the tubing at the extreme end of the longer portion is deformed to provide a lip extending away from the axis of the tubing in the direction of the plane of symmetry, and the pulling apparatus is adapted to engage a link adapted for applying a pulling force on the earth anchor.

A method is provided for practicing the invention, comprising steps of (a) lowering an earth anchor into a bore extending into the earth from a surface of the earth, the earth anchor comprising a body section formed from a hollow tubing having a long axis lying in a plane of symmetry and ends cut in planes, each end plane forming an acute angle with the axis on the same side of the axis, and intersecting the plane of symmetry of the tubing at right angles, an axle positioned within the hollow tubing in a portion of the tubing between the end planes, the axle fixedly attached across the tubing in a direction substantially at a right angle to the plane of symmetry, and a pulling apparatus pivotally attached to the axle such that the pulling attachment may be rotated around the axle through an angle of at least ninety degrees, to extend in one aspect parallel to the axis of the tubing, and in another aspect at ninety degrees to the axis through an opening from one end adapted to provide clearance for rotation of the pulling apparatus; (b) pulling upward on the pulling apparatus from outside the bore on the earth's surface by means of a link engaged to the pulling apparatus, causing the earth anchor to rotate in the earth bore, engage earth in walls of the bore, and to penetrate the walls, rotating about the axle to a position wherein the long axis of the body section is substantially horizontal to the surface of the earth; (c) connecting the link to a structure to be anchored on the earth's surface; and (d) providing tension in the link between the structure to be anchored and the earth anchor.

BRIEF DESCRIPTION OF THE DRAWING FIGURES

Figure 1:
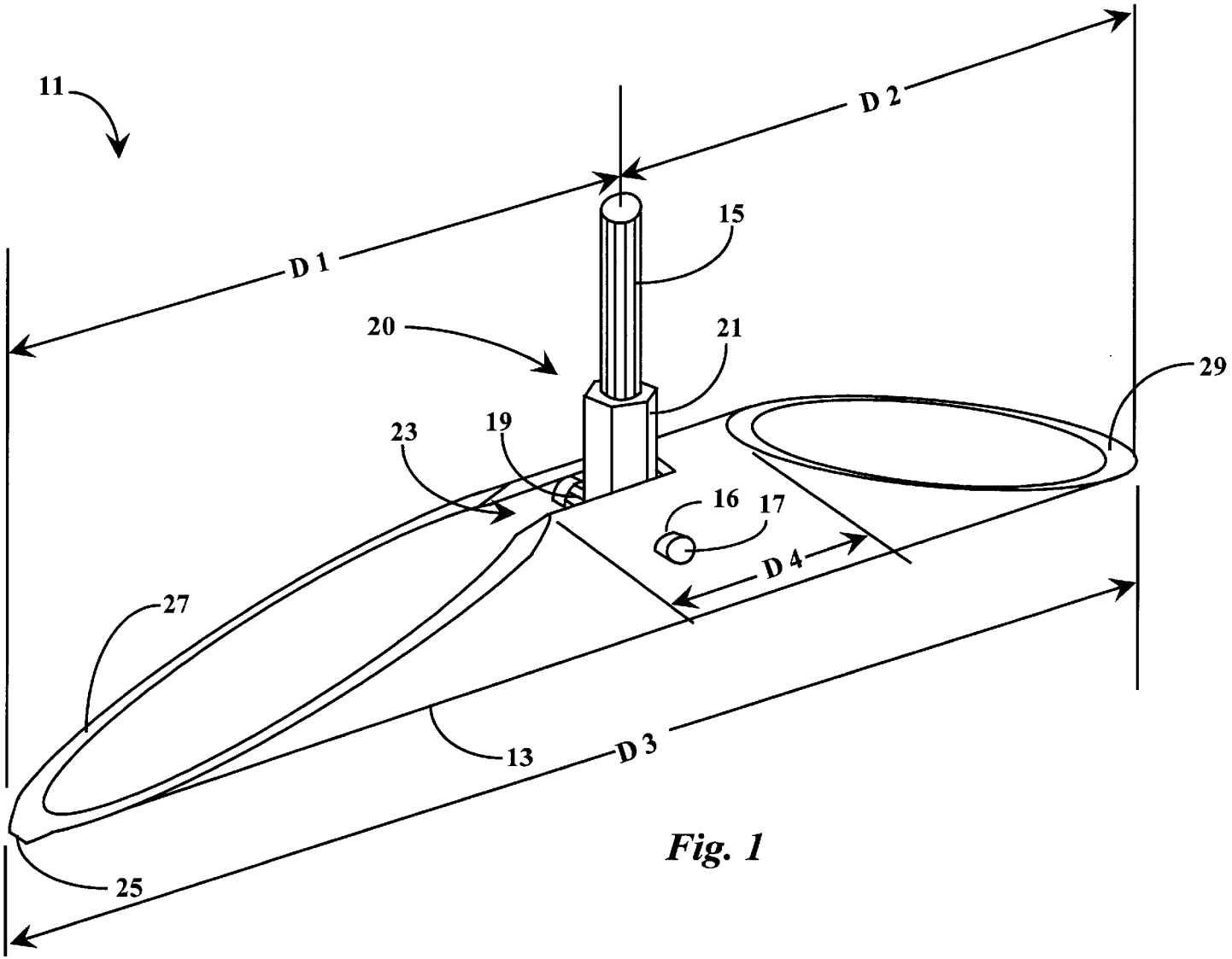
FIG. 1 is an isometric view of a cut-pipe earth anchor in an embodiment of the present invention.
Figures 3A, 3B, 3C:
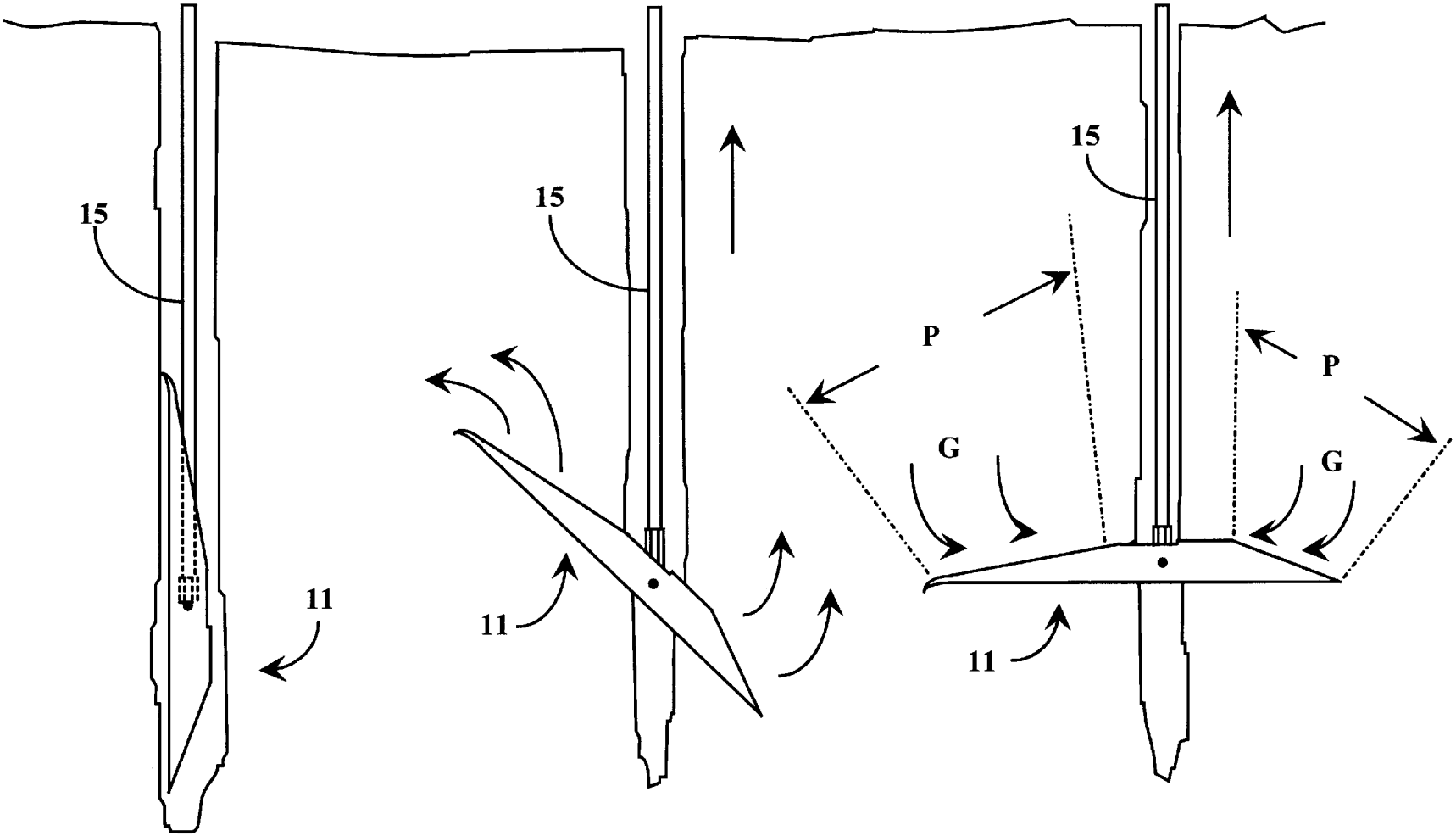

FIGS. 3A–C illustrate the use of the anchor of FIG. 1 in an embodiment of the present invention.

DESCRIPTION OF THE PREFERRED EMBODIMENTS

FIG. 1 is an isometric view of a cut-pipe earth anchor 11 according to an embodiment of the present invention, wherein a pipe section 13 forms the main body of the anchor. Pipe 13 section may be fashioned from any stock of heavy-gauge standard pipe suitable in strength, such as steel or iron. It will be apparent to one with skill in the art that any material can be used for pipe 13 provided it is strong enough to sustain suitable loads as experienced in earth anchoring. The inventor considers it preferable to fashion anchors from existing standard pipe, as this procedure provides a relatively low-cost approach to making such anchors.

One end of pipe section 13 in the embodiment illustrated is cut at an angle of about 15 degrees with the longitudinal center line of the pipe section, forming a plane cut surface 27. Cut surface 27 in a preferred embodiment is all in a single plane, but in some embodiments, the cuts through wall sections of the pipe may be at an angle rather than in a flat plane, providing thereby a sharpened edge along the cut. It will be apparent to those with skill in the art that cut surface 27 can be made in any suitable fashion known in the art, such as a saw cut, by milling, by flame cutting, and the like.

A second plane cut surface 29 is provided at the opposite end of pipe section 13 from cut surface 27 along a cutting plane at an angle in the embodiment shown of approximately 25 degrees with the axis of the pipe section. There is nothing limiting about one angle being about 15 degrees and the other 25 degrees in this embodiment. These angles and their relationship are simply a consequence of pipe section diameter and length, and placement of a pivotally attached pulling mechanism 20 along the length of pipe section 13.

For many construction applications a pipe diameter in the range of from two to six inches (nominal) is desirable. It is preferable, as stated above that standard pipe be used. In some lighter-duty applications smaller diameter pipe will be suitable, and in some heavier-duty applications larger diameters may be used. In many applications a length D3 of from two to four feet is suitable, and longer or shorter pipe sections may be used as conditions may demand.

In preferred embodiments pulling mechanism 20 is not attached at the center of the length of the pipe section, rather D1 is provided as somewhat longer than D2. D1 is in many embodiments about 55% of overall length D3, and D2 is about 45% of length D3. The reason for this off-center attachment has to do with operation of the anchor in deploying the anchor in a bore, as is described in more detail below.

Pulling mechanism 20 attaches in this embodiment via an axle 17 welded into pipe section 13 in a transverse bore having an axis at right angles to the longitudinal axis of pipe section 13, and passing somewhat above the axis of the pipe section. A rectangular window 23 is provided in pipe section 13 and opens into the plane of cut-surface 27, that is, toward the long end of pipe section 13. This window is substantially symmetrical about a line in the pipe outer surface described by a vertical plane through the long axis of pipe section 13, forming a right angle with each of the planes described by cut-surfaces 27 and 29. Rectangular window 23 provides a rotation area for mechanism 20, such that a pulling link 15 may lie parallel to the long axis of pipe section 13, or be rotated to strike a right angle with the long axis of the pipe section. The purpose will be plain from further description below. The pulling link in some embodiments may be a cable, and in others a linked series of rods. Other sorts of pulling links may be useful as well.

Cut surfaces 27 and 29 are made in pipe section 13 in a manner to leave a length D4 of from 4 to 6 inches in this embodiment, providing a very strong anchoring structure for mechanism 20. It is the length of this center section, along with the overall diameter and length and the offset position of mechanism 20 relative to the length of pipe section 13 that determines the angles of the cut-surfaces, which may vary widely from the exemplary dimensions provided herein.

At the end of cut surface 27 nearest the end of the pipe section, the material is formed somewhat down and at an angle to form a warped edge 25. Warped edge 25 is provided for the purpose of catching the wall of an earth bore after anchor 11 is presented at the desired depth in the bore and ready to be rotated, as further described below.

Figure 2B:
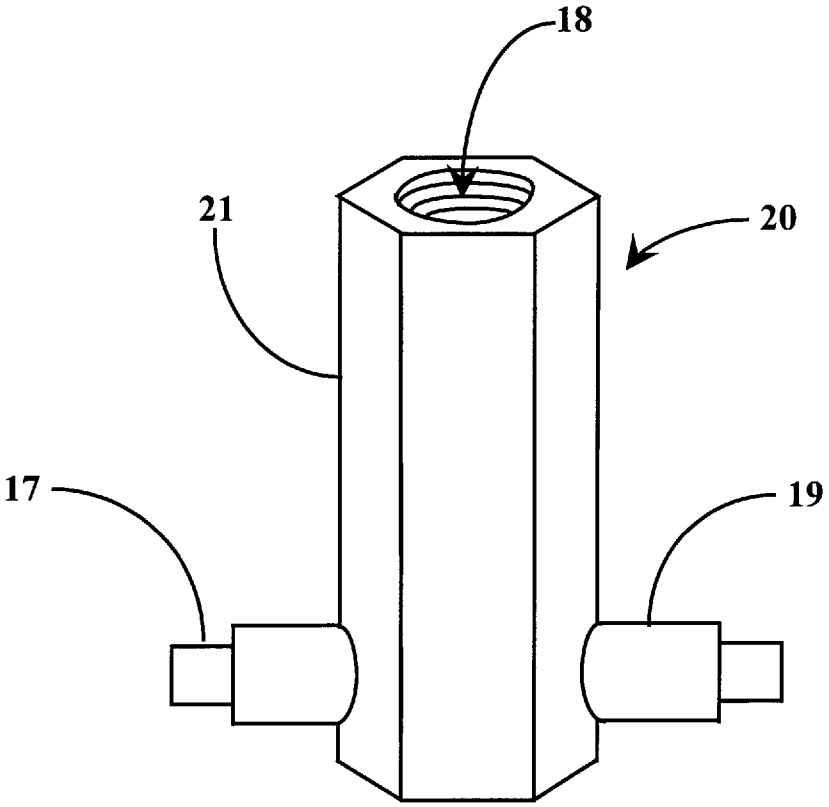
FIG. 2B is an elevation view of an alternative axle and pulling apparatus.
Figure 2A:
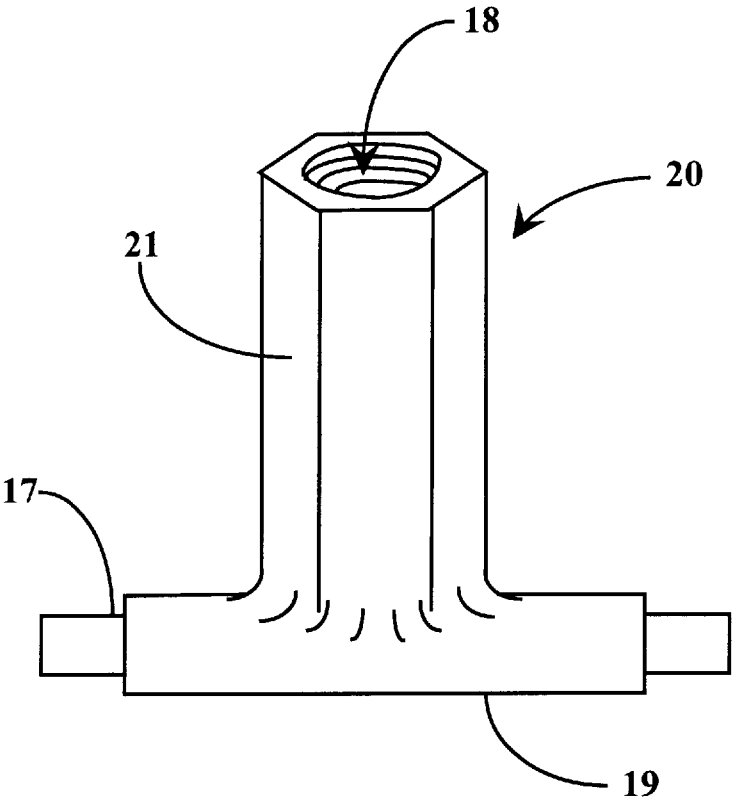
FIG. 2A is an elevation view of an axle and pulling apparatus of the anchor of FIG. 1, as used in embodiments of the present invention.

FIG. 2A is an elevation view of one embodiment of pulling mechanism 20 introduced above. In this embodiment a hex section 21 has a threaded bore 18 for engaging a male threaded end of a pulling link 15 (FIGS. 1 and 3). Hex section 21 is welded to an axle sleeve 19 having a bore of sufficient diameter to provide a slip fit with axle 17. The clearance between sleeve 19 and axle 17 may vary considerably, as long as the sleeve is allowed to rotate on the axle.

In assembly of the pulling mechanism to pipe section 13, the hex section is positioned within the pipe section such that sleeve 19 aligns with bore 16 shown in FIG. 1, axle 17 is inserted to pass through sleeve 19 and engage in bore 16 through both sides of pipe section 13, and axle 17 is then welded to the pipe section. The length of sleeve 19 is provided as long as is practical within pipe section 13 to maximize the area of engagement of the sleeve with the axle.

FIG. 2B is an elevation view illustrating an alternative embodiment of pulling mechanism 20 wherein sleeve 19 is a separate piece from hex portion 21, and is press-fit into place through a bore made in hex portion 21. Sleeve 19 and axle 17 still provide a rotating coupling, and assembly to the pipe portion is as described above.

It will be apparent to those with skill in the art that there are variations that may be made in the way that the pulling assembly is made without departing from the spirit and scope of the invention.

Pulling mechanism 20 provides a convenient attachment by which a suitable pulling link may be joined to the anchor, allowing a tensioned coupling to be made to an above-ground structure. The pulling member may take a number of different forms, such as wire, guy rods, rope, chain, linked rods, an so forth.

FIGS. 3A–3C illustrate function of anchor 11 of FIG. 1 as used in an embodiment of the present invention. To deploy anchor 11 a bore is provided of a suitable diameter and depth. The diameter must be sufficient for anchor 11 to be freely lowered in the bore to a desired depth, and the desired depth will depend on, among other things, the kind of soil encountered and the desired holding force to be provided by the anchor.

Once an earth bore is provided, anchor 11 is lowered into the earth bore, as shown in FIG. 3A. At a desired depth, an upward motion on pulling member 15, because of the offset of attachment mechanism 20 from the center of length D3, causes anchor 11 to begin to rotate as shown in FIG. 3B. Upset end 25 engages the earth on one side of the earth bore, and penetrates the earth on that side, aided by the fact of upset end 25. As upward motion increases with enough force applied, anchor 11 continues to rotate until substantially horizontal, or at a right angle to the axis of the earth bore, as shown in FIG. 3C. As the earth anchor comes into position, its ability to resist further movement increases, and is maximum when the anchor is at a right angle to the earth bore.

As earth anchor 11 rotates into its position of maximum resistance, earth is compacted into the interior of pipe section 13 via the cut ends, and this earth is compressed by the force applied via the pulling mechanism. The effect of this compaction is as though cut planes 27 and 29 (FIG. 1) become surfaces of a solid rod of the diameter of the pipe section. This effect provides a significant advantage in that inexpensive pipe may be used for construction of the anchor while still providing an effect equivalent to having provided solid planar surfaces.

FIG. 3C shows anchor 11 in a final horizontal position and lodged completely into the sides of the earth bore. In this position the two cut surfaces 27 and 29 provide resistance to further movement in a unique fashion. The projection of forces from these surfaces provides a double-cone earth effect as illustrated by dimensions P in FIG. 3C. Effectively more earth above the anchor is brought into play than is true in prior art anchors, and anchors according to embodiments of the present invention therefore are capable of sustaining greater loading than as heretofore been the case.

It will be apparent to one with skill in the art that there are many materials, as well as, many different configurations that may be incorporated into anchor 11 without departing from the spirit and scope of the present invention. For example, in various embodiments, various shapes can be used for pipe 13 of FIG. 1 as mentioned with reference to FIG. 1. That is, section 13 may be made of round pipe, square stock, or of any formed or extruded tubing. Round pipe is a preferred shape. In one embodiment, iron may be used in the fabrication of anchor 11, whereas, in other embodiments, steel, other metal alloys, or any other suitable material can be used. Also, it will be apparent to one with skill in the art that anchor 11 can be provided in various sizes as may be required for use in various construction projects. These and other variations are possible as are taught herein, and the invention is limited therefore only by the breadth of the claims which follow.

What is claimed is:

1. An earth anchor comprising:

a body section formed from a hollow tubing having an axis lying in a plane of symmetry and ends cut in planes, each end plane forming an inward acute angle with the axis on the same side of the axis, and intersecting the plane of symmetry of the tubing at right angles;

an axle positioned within the hollow tubing in a portion of the tubing between the end planes, the axle fixedly attached across the tubing in a direction substantially at a right angle to the plane of symmetry; and a pulling apparatus pivotally attached to the axle such that the pulling apparatus may be rotated around the axle through an angle of at least ninety degrees, to extend in one aspect parallel to the axis of the tubing, providing thereby a folded and compact aspect allowing the earth anchor to be inserted in a bore in the earth, and in another aspect to extend at ninety degrees to the axis of the tubing, such that, with the pulling apparatus directed at ninety degrees to the axis of the tubing, the end planes of the body section face upward and outward from the direction of pulling, and compact earth in separate patterns upward and away from the direction of pulling.

2. The earth anchor of claim 1 wherein the hollow tubing is metal pipe of circular cross-section.

3. The earth anchor of claim 1 wherein the axle position is offset from center of the overall length of the tubing, providing thereby a longer portion to one side of the axle and a shorter portion to the other side of the axle.

4. The earth anchor of claim 1 wherein the acute angles are different angles, and are each less than forty-five degrees.

5. The earth anchor of claim 1 wherein the axle has a central axis, and the axle axis is offset to the same side of the axis of the tubing as the disposition of the acute angles of the planes, such that the axis of the axle and the axis of the tubing do not intersect.

6. The earth anchor of claim 3 wherein the material of the tubing at the extreme end of the longer portion is deformed to provide a lip extending away from the axis of the tubing in the direction of the plane of symmetry.

7. The earth anchor of claim 1 where in the pulling apparatus is adapted to engage a link adapted for applying a pulling force on the earth anchor.

8. A method for anchoring an object firmly to the earth, comprising step of:

(a) lowering an earth anchor into a bore extending into the earth from a surface of the earth, the earth anchor comprising a body section formed from a hollow tubing having a long axis lying in a plane of symmetry and ends cut in planes, each end plane forming an acute angle with the axis on the same side of the axis, and intersecting the plane of symmetry of the tubing at right angles, an axle positioned within the hollow tubing in a portion of the tubing between the end planes, the axle fixedly attached across the tubing in a direction substantially at a right angle to the plane of symmetry, and a pulling apparatus pivotally attached to the axle such that the pulling attachment may be rotated around the axle through an angle of at least ninety degrees, to extend in one aspect parallel to the axis of the tubing, and in another aspect at ninety degrees to the axis through an opening from one end adapted to provide clearance for rotation of the pulling apparatus;

(b) pulling upward on the pulling apparatus from outside the bore on the earth's surface by means of a link engaged to the pulling apparatus, causing the earth anchor to rotate in the earth bore, engage earth in walls of the bore, and to penetrate the walls, rotating about the axle to a position wherein the long axis of the body section is substantially horizontal to the surface of the earth;

(c) connecting the link to a structure to be anchored on the earth's surface; and (d) providing tension in the link between the structure to be anchored and the earth anchor, whereby each of the two angled end planes of the deployed earth anchor create upwardly directed compaction cones each having an axis divergent from the axis of the principle line of force.

9. An earth anchor comprising:

a body section formed from a hollow length of pipe of circular cross-section, the pipe having a center axis lying in a plane of symmetry and ends cut in planes, each end plane forming an inward acute angle of less than forty-five degrees with the axis on the same side of the axis, and intersecting the plane of symmetry of the pipe at right angles;

an axle positioned within the pipe in a portion of the pipe between the end planes, the axle fixedly attached to outer walls across the pipe in a direction substantially at a right angle to the plane of symmetry, the axle positioned offset from the central axis on the same side of the axis as the acute angles and positioned also offset from center of the overall length of the pipe, providing thereby a longer portion to one side of the axle and a shorter portion to the other side of the axle; and a pulling apparatus pivotally attached to the axle such that the pulling apparatus may be rotated around the axle through an angle of at least ninety degrees, to extend in one aspect parallel to the axis of the pipe, providing thereby a folded and compact aspect allowing the earth anchor to be inserted in a bore in the earth, and in another aspect to extend at ninety degrees to the axis of the pipe, such that, with the pulling apparatus directed at ninety degrees to the axis of the pipe, the end planes of the body section face upward and outward from the direction of pulling, and compact earth in separate patterns upward and away from the direction of pulling.

* * * * *